US010194733B2

(12) United States Patent
Robert

(10) Patent No.: US 10,194,733 B2
(45) Date of Patent: Feb. 5, 2019

(54) BACKPACK SYSTEM

(71) Applicant: Plano Molding Company, Plano, IL (US)

(72) Inventor: Jay Robert, Star, ID (US)

(73) Assignee: Plano Molding Company, Plano, IL (US)

( * ) Notice: Subject to any disclaimer, the term of this patent is extended or adjusted under 35 U.S.C. 154(b) by 701 days.

(21) Appl. No.: 13/968,922

(22) Filed: Aug. 16, 2013

(65) Prior Publication Data

US 2014/0239031 A1 Aug. 28, 2014

Related U.S. Application Data

(63) Continuation-in-part of application No. 29/457,449, filed on Jun. 10, 2013, now Pat. No. Des. 699,941, and a continuation-in-part of application No. 29/446,319, filed on Feb. 22, 2013, now Pat. No. Des. 691,792.

(51) Int. Cl.
*A45F 3/08* (2006.01)

(52) U.S. Cl.
CPC ..... *A45F 3/08* (2013.01)

(58) Field of Classification Search
CPC ..... A45F 3/08; A45F 3/04; A45F 3/047
USPC ..... 224/633, 634, 637
See application file for complete search history.

(56) References Cited

U.S. PATENT DOCUMENTS 4,318,502 A 3/1982 Lowe et al.
4,750,654 A 6/1988 Menetrier
4,934,573 A * 6/1990 Jaeger ..... 224/628
5,131,576 A * 7/1992 Turnipseed ..... 224/262
5,320,262 A 6/1994 Levis
D352,822 S 11/1994 Levis
D355,297 S 2/1995 Ash
D369,021 S 4/1996 Kliot
5,553,759 A * 9/1996 McMaster et al. ..... 224/631
5,564,612 A * 10/1996 Gregory ..... 224/633
5,704,530 A * 1/1998 Scherer ..... 224/632
5,762,243 A 6/1998 McMaster et al.
5,762,251 A * 6/1998 Gleason ..... 224/635
5,806,740 A 9/1998 Carlson
5,836,489 A 11/1998 Swetish
5,954,253 A * 9/1999 Swetish ..... 224/631
D418,972 S 1/2000 Gold
D426,700 S * 6/2000 Gregory ..... D3/216
6,216,926 B1 4/2001 Pratt
6,243,892 B1 6/2001 Kelling
D453,873 S * 2/2002 Blanking ..... D3/217
(Continued)

FOREIGN PATENT DOCUMENTS

CA 152367 4/2014

*Primary Examiner* — Derek Battisti
(74) *Attorney, Agent, or Firm* — Leason Ellis LLP

(57) ABSTRACT

The present disclosure provides a lightweight, ergonomically improved backpack system comprising a storage section, an upper harness, a lower harness and an ergonomic backpack frame, that may be configured to facilitate the carrying of loads that may substantially exceed the weight of the ergonomic backpack frame. The ergonomic backpack frame may include a flex portion that includes at least one flex region. The flex portion of the ergonomic backpack frame may allow the backpack frame to substantially conform to a user's back while walking during utilization of the backpack system.

23 Claims, 7 Drawing Sheets

(56) References Cited

U.S. PATENT DOCUMENTS

| | | | | |
|---|---|---|---|---|
| D507,697 | S | 7/2005 | Seong | |
| 7,021,508 | B1 | 4/2006 | Aston | |
| 7,028,873 | B1 | 8/2006 | Collier et al. | |
| D550,448 | S | 9/2007 | Boje et al. | |
| 7,287,677 | B2 | 10/2007 | Reid | |
| D603,157 | S | 11/2009 | Hutchinson | |
| 7,644,847 | B2 | 1/2010 | Howell | |
| 7,673,777 | B2 | 3/2010 | Gleason, Jr. | |
| 7,717,310 | B2 * | 5/2010 | Zalinsky et al. | 224/644 |
| 7,793,809 | B2 | 9/2010 | Howell | |
| D624,749 | S | 10/2010 | Evans | |
| 7,851,932 | B2 | 12/2010 | Rome et al. | |
| D630,011 | S | 1/2011 | Knight et al. | |
| D630,427 | S | 1/2011 | McGuire | |
| D641,973 | S | 7/2011 | Quehl | |
| D642,791 | S | 8/2011 | Quehl | |
| 8,118,201 | B1 | 2/2012 | Calkin | |
| 8,123,581 | B2 | 2/2012 | Aschauer | |
| 8,157,138 | B2 * | 4/2012 | Leyendecker | 224/637 |
| D665,573 | S | 8/2012 | Crandall | |
| D673,363 | S | 1/2013 | Crandall | |
| D691,792 | S | 10/2013 | Robert | |
| D699,940 | S | 2/2014 | Robert | |
| D699,941 | S | 2/2014 | Robert | |
| 8,925,774 | B2 * | 1/2015 | Mori et al. | 224/261 |
| 2005/0035170 | A1 | 2/2005 | Sears et al. | |
| 2005/0230445 | A1 | 10/2005 | Woo | |
| 2006/0163305 | A1 | 7/2006 | Tong | |
| 2008/0029562 | A1 | 2/2008 | Hawkins et al. | |
| 2008/0116026 | A1 | 5/2008 | Bass et al. | |
| 2010/0032464 | A1 | 2/2010 | Gleason, Jr. | |
| 2010/0176171 | A1 * | 7/2010 | Araujo et al. | 224/600 |
| 2010/0176172 | A1 | 7/2010 | Gleason, Jr. | |
| 2011/0108595 | A1 | 5/2011 | Hoag | |
| 2012/0031936 | A1 | 2/2012 | Hairston et al. | |
| 2012/0199624 | A1 | 8/2012 | Howell | |
| 2012/0217279 | A1 | 8/2012 | Murdoch et al. | |
| 2012/0234879 | A1 | 9/2012 | Lester | |
| 2012/0261445 | A1 | 10/2012 | Demskey | |
| 2013/0001268 | A1 | 1/2013 | Hairston et al. | |

* cited by examiner

BACKPACK SYSTEM

RELATED PATENT APPLICATIONS

This application is a continuation-in-part of U.S. Design patent application Ser. No. 29/446,319, filed Feb. 22, 2013, which is hereby incorporated herein by reference in its entirety. This application is also a continuation-in-part of U.S. Design patent application Ser. No. 29/457,449, filed Jun. 10, 2013, which is hereby incorporated herein by reference in its entirety.

BACKGROUND OF THE DISCLOSURE

1. Field of the Disclosure

This disclosure is generally directed to a backpack system that may include a plurality of components that function together in order to enable a user utilizing the backpack system to carry loads that weigh substantially more than the backpack system.

2. Related Art

Conventional backpacks are generally comprised of many different shapes, styles, and sizes. For example, there are many different types of bags that include a storage area and shoulder straps that facilitate the carrying of a load from a user's place of origin to a particular destination.

However, conventional backpacks typically have limits to the weight of the load that the backpack can carry. In addition, certain conventional backpacks that lack a satisfactory backpack frame may be subject to failure while in use. Such a failure may include, among other things, e.g., the backpack being unable to adequately support the weight a particular load that a user desires to carry. As a result, there exists a long-felt need in the art for a lightweight, ergonomically improved backpack system that is able to facilitate the carrying of loads of substantial weight and/or size.

SUMMARY OF THE DISCLOSURE

The present disclosure meets the forgoing need and provides a lightweight, ergonomically improved backpack system that is able to facilitate the carrying of loads of substantial weight and/or size.

According to one aspect of the disclosure, a backpack system is provided that comprises a storage section; an upper harness; a lower harness; and, a backpack frame, wherein the backpack frame includes: a flex portion that includes at least one flex region, at least two openings, and, at least two recesses on the edge of the backpack frame.

The backpack frame may include at least one slot.

The backpack frame may include a front face and a rear face, wherein the front face may be concaved.

The backpack frame may include a plurality of columns of slots.

The plurality of columns of slots may include a column of horizontal slots and a column of vertical slots.

The flex portion of the backpack frame may include at least one pair of columns of vertical slots, wherein each column in the pair of columns of vertical slots may be substantially parallel to another column in the pair of columns of vertical slots.

Another aspect of the disclosure may provide an ergonomic backpack frame, comprising: at least one opening; a first recess in the edge of the backpack frame; and, a second recess in the edge of the backpack frame, wherein the at least one opening, the first recess, and the second recess are positioned to create a flex portion that accommodates one-way flexing.

The flex portion may include at least one flex region.

The flex portion may include a first flex region and a second flex region.

The backpack frame may not substantially flex in response to a force exerted by a load in the rearwards direction.

The backpack frame may include a front face and a rear face, wherein the front face may be concaved.

The at least one opening may include a plurality of openings.

The backpack frame may include at least one column of horizontal slots and at least one column of vertical slots.

The first recess or the second recess may intersect with the at least one column of vertical slots.

Another aspect of the present disclosure may provide a backpack system, comprising: a storage section; an upper harness; a lower harness, wherein the lower harness includes: lower back padding, an ergonomic hip belt, an adjustable hip belt strap adjuster, a first side pouch, a second side pouch; and, a backpack frame.

The ergonomic hip belt may be inversely shaped.

The inversely shaped hip belt may be configured in an upside down substantially U-shaped configuration.

The inversely shaped hip belt may be configured to engage a user's hips so that the backpack system cannot slide down a user's back.

The backpack frame may include a plurality of slots and a plurality of openings.

The lower harness may be coupled to the backpack frame using at least one of the plurality of slots and at least one of the plurality of openings.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

Figure 1:
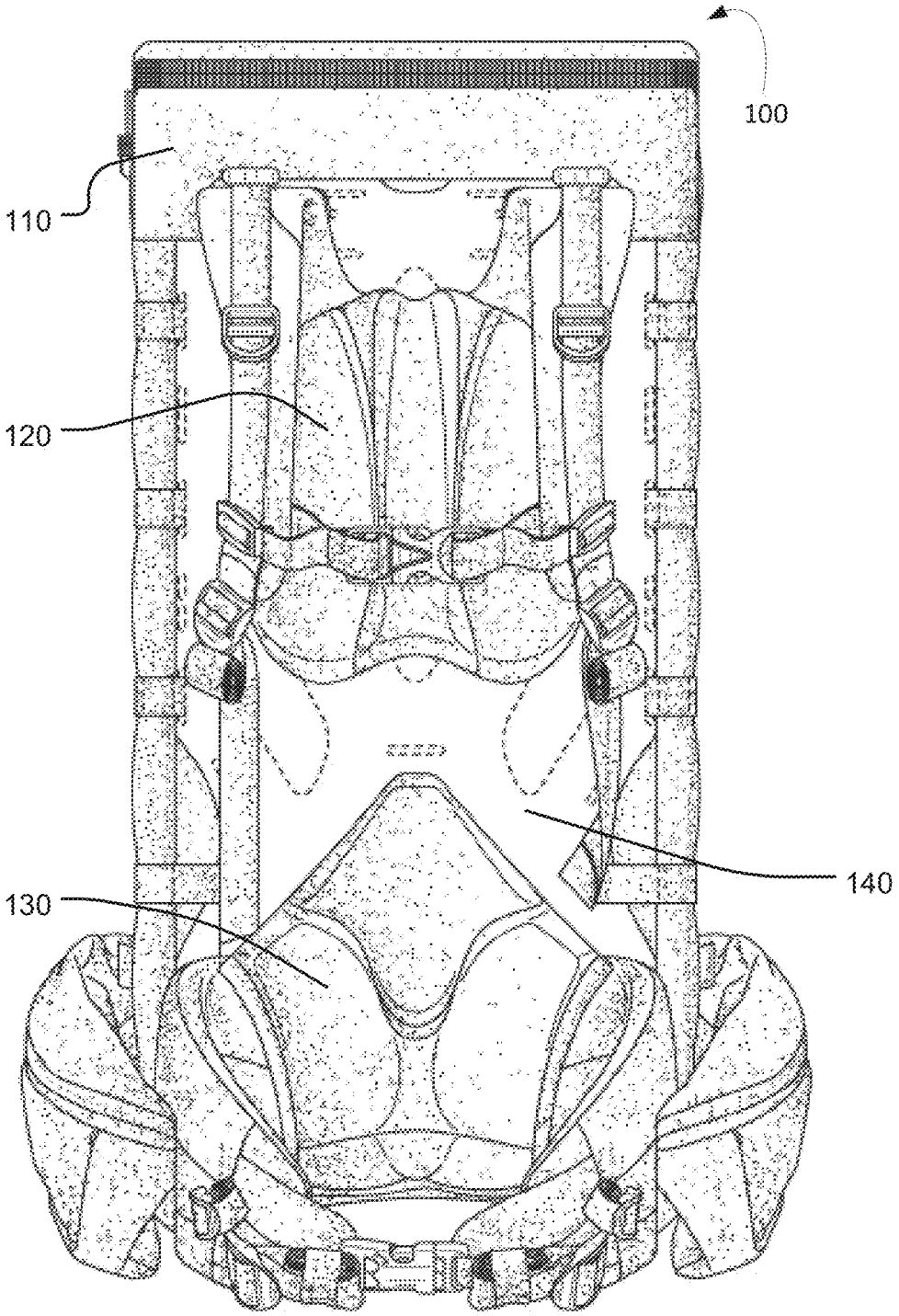
FIG. 1 shows an example of a backpack system in accordance with one aspect of the present disclosure.

The present disclosure is further described in the detailed description that follows.

DETAILED DESCRIPTION OF THE DISCLOSURE

The embodiments of the disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

FIG. 1 shows an example of a backpack system 100 in accordance with one aspect of the present disclosure. Backpack system 100 may include, among other things, e.g., a storage section 110, an upper harness 120, a lower harness 130, and a backpack frame 140. Each of these features will be discussed in greater detail herein below.

Figure 2:
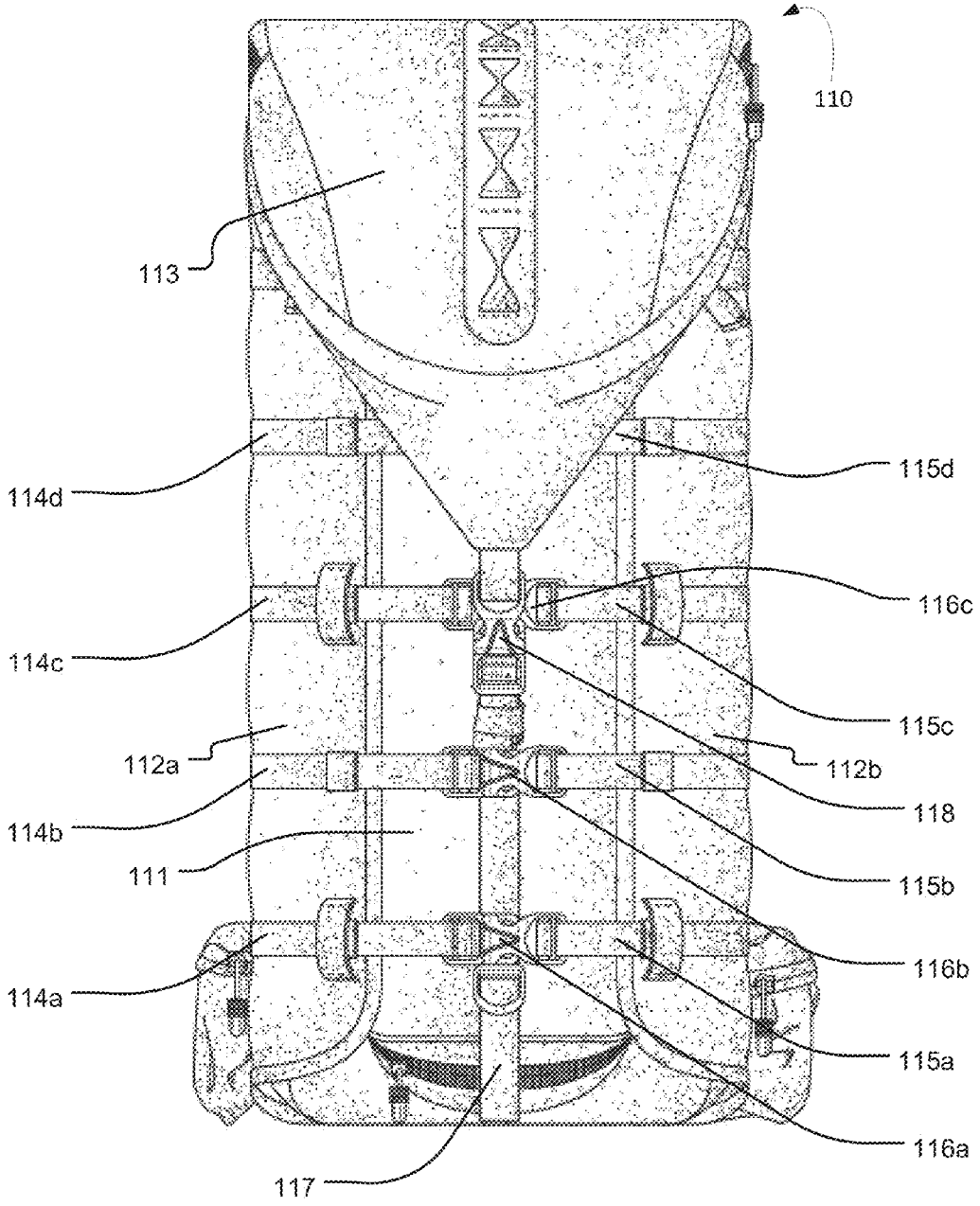
FIG. 2 shows an example of a storage section of a backpack system in accordance with one aspect of the present disclosure.

FIG. 2 shows an example of a storage section 110 of backpack system 100 in accordance with one aspect of the present disclosure. Storage section 110 may include, among other things, e.g., a bag 111, a first wing 112*a*, a second wing 112*b*, a lid 113, one or more first wing adjustable horizontal straps 114*a*, 114*b*, 114*c*, 114*d*, one or more second wing adjustable horizontal straps, 115*a*, 115*b*, 115*c*, 115*d*, one or more horizontal strap connectors 116*a*, 116*b*, 116*c*, one or more adjustable vertical straps 117, and one or more vertical strap connectors 118. Storage section 110 may also include a shelf flap (not shown) that may extend from the bottom of backpack system 100. Each of the aforementioned storage section features may be, e.g., individual, standalone features of the storage section that are each coupled to backpack frame 140 separately. Alternatively, however, each of the aforementioned storage section features may, e.g., each be attached to one another as a single, unibody storage section and then may be subsequently coupled to the backpack frame 140. Regardless of the specific configuration of storage section features that are utilized within the backpack system (i.e., standalone individual feature configuration, unibody configuration, or some combination thereof), the storage section may function to envelope, or otherwise contain, a load comprising one or more objects, to facilitate the carrying of the load over what may be great distances, e.g., on foot throughout a town, city, park, forest, jungle, wilderness area, or other geographical expanse.

Each feature of storage section 110 may be securely coupled to one or more slots or openings (shown in FIGS. 5, 6, and 7) of backpack frame 140 by utilizing one or more backpack frame accessory connectors or fasteners that include, among other things, e.g., buckles, clips, hooks, snaphooks, cord locks, slip locks, straps, hook-and-loop (e.g., Velcro), or the like. The backpack frame accessory connectors may be made of any material including, but not limited to, e.g., metal (e.g., steel, copper, aluminum, etc.), plastic, leather, cloth, carbon fiber, or the like.

After each feature of storage section 10 is securely coupled to the backpack frame, the first wing 112*a* and the second wing 112*b* may be wrapped around the bag 111 and secured in place utilizing, e.g., one or more adjustable horizontal straps 114*a*, 114*b*, 114*c*, 115*a*, 115*b*, 115*c* and/or one or more of horizontal strap connectors 116*a*, 116*b*, 116*c*. Similarly, either before or after the first wing 112*a* and second wing 112*b* are secured in place, the shelf flap (if present, not shown) and lid 113 may be wrapped around the bottom and top of bag 111 respectively and secured in place utilizing, e.g., one or more adjustable vertical straps 117 and/or one or more vertical strap connectors 118. The length of each adjustable strap may be adjusted utilizing a strap length adjustment tool such as, e.g., a buckle. Each of the horizontal connectors 116*a*, 116*b*, 116*c* and vertical connectors 118 may be, e.g., selected from a wide variety of connectors known in the art such as, e.g., buckles, clips, hooks, snaphooks, cord locks, slip locks, straps, hook-and-loop, or the like.

Alternatively (or additionally), the storage section 110 may be configured to envelope, or otherwise contain, a load comprising one or more objects without (or in addition to) the use of a bag 111. This alternative configuration may be achieved by, e.g., utilizing the first wing 112*a*, second wing 112*b*, shelf flap (not shown), and lid 113 to completely envelope and secure the load with the assistance of, e.g., one or more horizontal straps 114*a*, 114*b*, 114*c*, 115*a*, 115*b*, 115*c*, horizontal strap connectors 116*a*, 116*b*, 116*c*, vertical straps 117, and vertical strap connectors 118.

Figure 3:
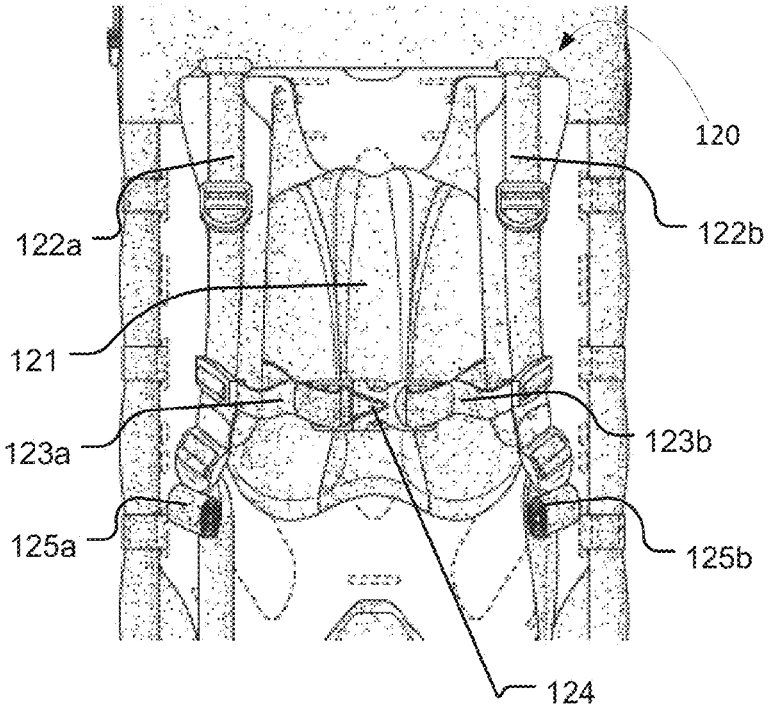
FIG. 3 shows an example of an upper harness of a backpack system in accordance with one aspect of the present disclosure.

FIG. 3 shows an example of an upper harness 120 of backpack system 100 in accordance with one aspect of the present disclosure. Upper harness 120 may include, among other things, e.g., back padding 121, a first adjustable shoulder strap 122*a*, a second adjustable shoulder strap 122*b*, a first adjustable chest strap 123*a*, a second adjustable chest strap 123*b*, a chest strap connector 124, a first load lifter 125*a*, and a second load lifter 125*b*. Upper harness 120 may be coupled to one or more slots or openings (shown in FIGS. 5, 6, and 7) of backpack frame 140 by using, e.g., backpack frame accessory connectors that include, among other things, e.g., buckles, clips, hooks, snaphooks, cord locks, slip locks, straps, hook-and-loop (e.g., Velcro), or the like.

Upper harness 120 may be configurable so that a user of backpack system 100 may achieve custom placement of storage section 110 in an optimal position on the user's back for carrying the load. A user may, e.g., configure the upper harness 120 at different locations on backpack frame 140 by utilizing harness adjustment slots and openings (shown in FIGS. 5, 6, and 7). Alternatively, or in addition, a user may configure the upper harness at different locations with respect to the user's back and hips by, e.g., utilizing load lifter's 125*a*, 125*b* to adjust the length of the first adjustable shoulder strap 122*a* and second adjustable shoulder strap 122*b* respectively. Alternatively, or in addition, a user may also configure the upper harness 120 by utilizing the adjustable chest straps 123*a*, 123*b*.

Figure 4:
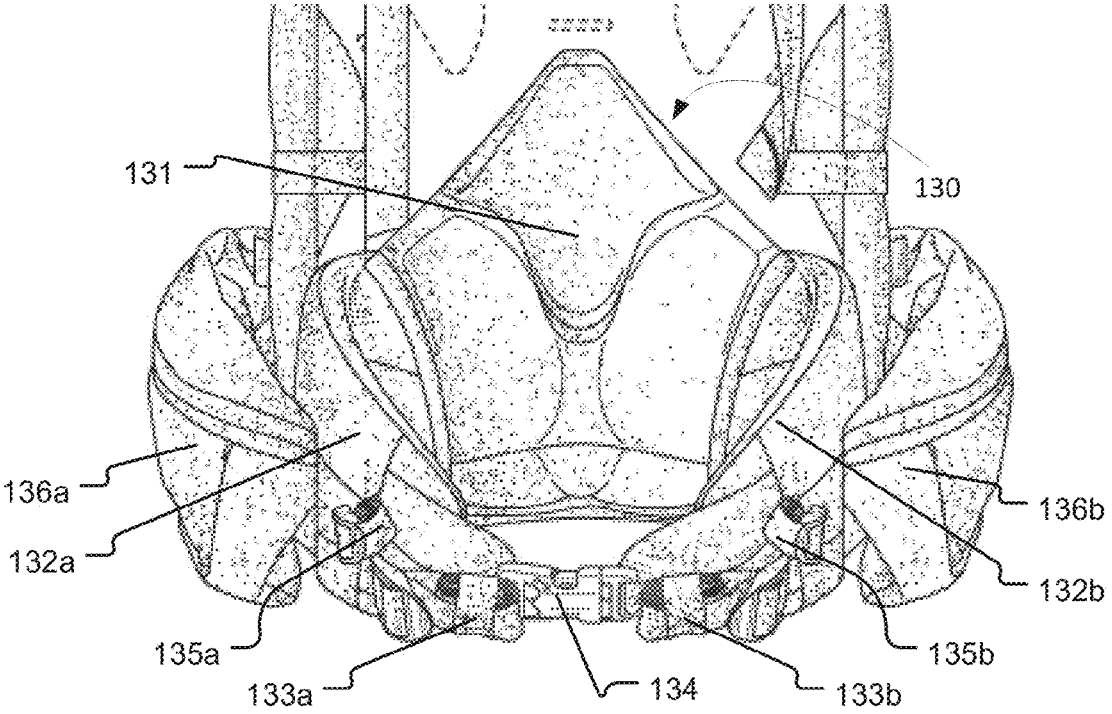
FIG. 4 shows an example of a lower harness of a backpack system in accordance with one aspect of the present disclosure.

FIG. 4 shows an example of a lower harness 130 of backpack system 100 in accordance with one aspect of the present disclosure. Lower harness 130 may include, among other things, e.g., lower back padding 131, a hip belt 132*a*, 132*b*, an adjustable hip belt strap 133*a*, 133*b*, a hip belt strap connector 134, a first hip belt strap adjuster 135*a*, a second hip belt strap adjuster 135*b*, a first side pouch 136*a*, and a second side pouch 136*b*. Lower harness 130 may be coupled to one or more slots or openings (shown in FIGS. 5, 6, and 7) of backpack frame 140 by using, e.g., backpack frame accessory connectors that include, among other things, e.g., e.g., buckles, clips, hooks, snaphooks, cord locks, slip locks, straps, hook-and-loop (e.g., Velcro), or the like. Lower harness 130 may be configurable by a user of the backpack system in a manner that is similar to upper harness 120 in order to achieve an optimal position on a user's back and hips for carrying a load.

Hip belt 132*a*, 132*b* may be ergonomically designed to precisely fit the hips of a user utilizing backpack system 100. The ergonomic design of hip belt 132*a*, 132*b* distinguishes from hip belts of conventional bags based at least in part on the shape of hip belt 132*a*, 132*b*. For example, hip belt 132*a* may be inversely shaped such that hip belt 132*a* may rest on the hips of a user. The inverse shape of hip belt 132*a* may allow a user's hips to assist in supporting the weight of a carried load. In accordance with at least one aspect of the present disclosure the inverse shape of hip belt 132*a*, 132*b* may be in the form of, e.g., an upside down substantially U-shaped configuration. This upside down substantially U-shaped configuration may be, e.g., arch-like in shape. This upside down substantially U-shaped configuration may be, e.g., the shape of hip belt 132*a* depicted in FIG. 4. Accordingly, the inverse configuration of hip belt 132*a* may prevent backpack system 100 from sliding off of a user's hips and down a user's back.

Hip belt 132*b* may be shaped the same as, or differently, than hip belt 132*a*. Hip belt 132*a*, 132*b* may be made of any material such as, e.g., cloth, leather, padding, plastic, or the like. Hip Belt 132*a* and hip belt 132*b* may each be separate, individual sections of the lower harness that are coupled to the lower back padding 131 and/or backpack frame 140. Alternatively, or in addition, hip belt 132*a* and hip belt 132*b* may be a single, belt-like section of the harness that may wrap around a user's waist and may be held securely in place by utilizing, e.g., one or more of an adjustable hip belt strap 133*a*, 133*b*, a hip belt strap connector 134, a first hip belt strap adjuster 135*a*, and/or a second hip belt strap adjuster 135*b*.

However, it is contemplated that the shape and configuration of hip belt 132*a*, 132*b* is not in any way limited to the embodiment set forth in FIG. 4. Instead, the hip belt of the present disclosure may be any shape and divided into any number of sections that facilitates use of backpack system 100 in way that is desired by a user.

Figure 5:
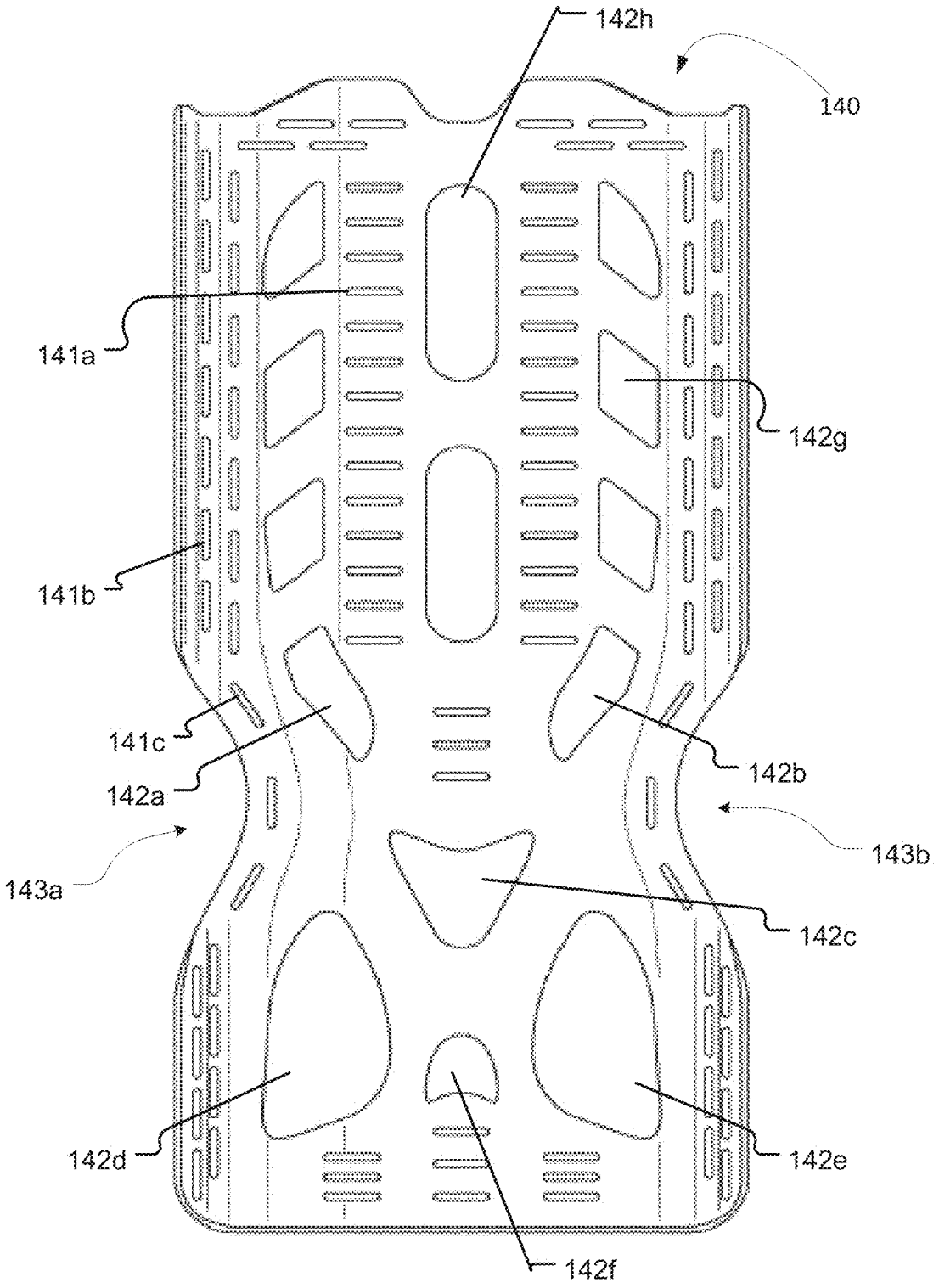
FIG. 5 shows an example of a backpack frame that may be associated with a backpack system in accordance with one aspect of the present disclosure.

FIG. 5 shows an example of backpack frame 140 that may be associated with backpack system 100 in accordance with one aspect of the present disclosure. Backpack frame 140 may include, among other things, e.g., one or more horizontal slots 141*a*, one or more vertical slots 141*b*, one or more diagonal slots 141*c*, one or more openings 142*a*, 142*b*, 142*c*, 142*d*, 142*e*, 142*f*, 142*g*, 142*h*, a first recess 143*a*, and a second recess 143*b*. Backpack frame 140 may be configured into any size and shape in order to accommodate backpack systems of different sizes and shapes so long as the functionality of backpack frame 140 still falls within the spirit and scope of the disclosure as described herein. In addition, backpack frame 140 may be made of any material. However, in accordance with at least one aspect of the disclosure, backpack frame 140 may be made of exceptionally strong, but lightweight, materials such as, e.g., carbon fiber.

Figure 6:
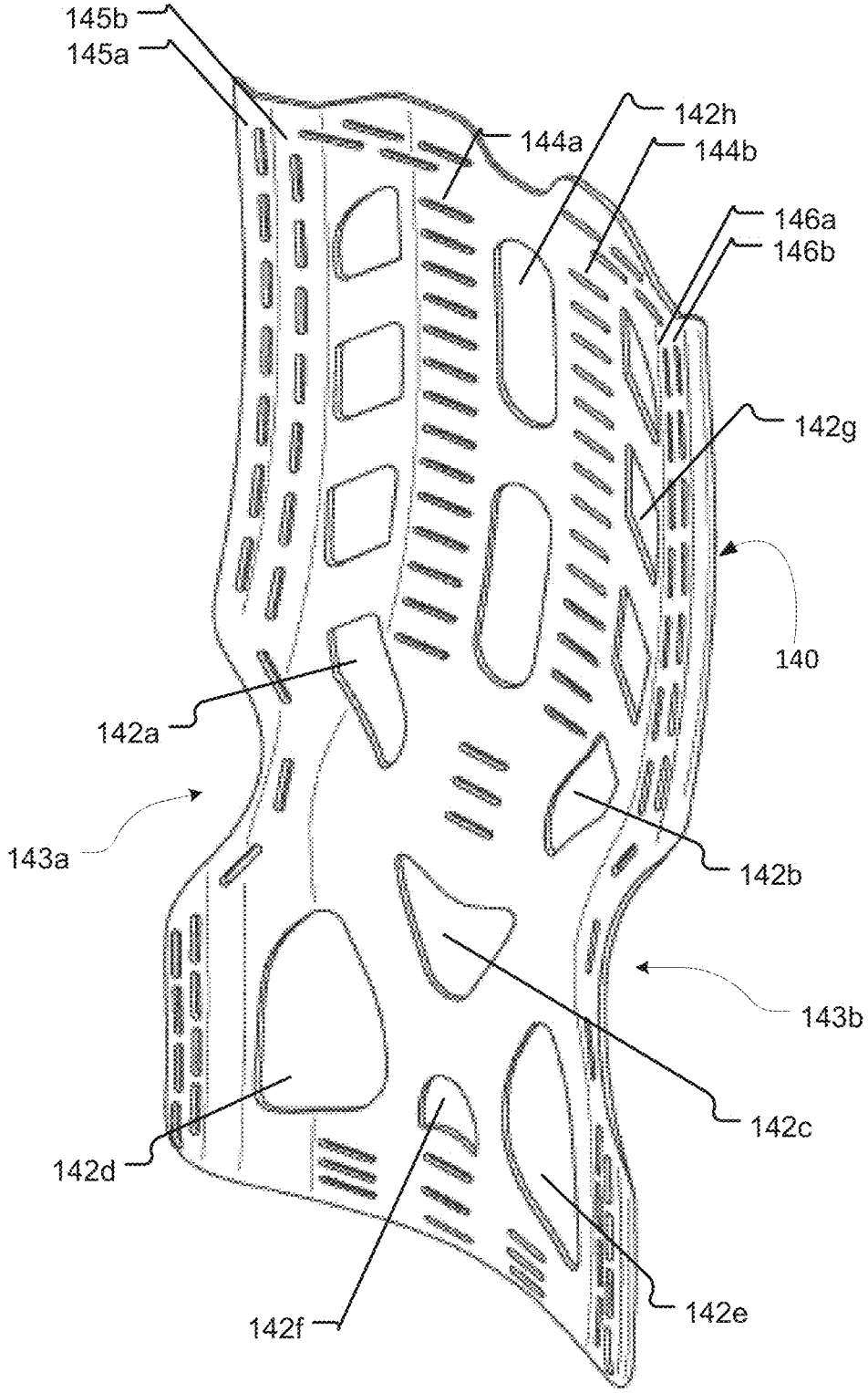
FIG. 6 shows a perspective view of a backpack frame that may be associated with a backpack system in accordance with one aspect of the present disclosure.

FIG. 6 shows a perspective view of backpack frame 140 that may be associated with backpack system 100 in accordance with one aspect of the present disclosure. The perspective view of backpack frame 140 set forth in FIG. 6 depicts the concave nature of the front face of backpack frame 140. The concave face of backpack frame 140 may be ergonomically designed, e.g., to substantially conform to the back of a user utilizing backpack system 100. The design may be configured to ergonomically fit a median population of users, or it may be provided in multiple sizes so as to fit users having different shapes and sizes. Alternatively, the design may be customized to fit individual users.

Furthermore, backpack frame 140 may be designed in order to flex or pivot while a user utilizing backpack system 100 walks, thereby enabling backpack frame 140 to maintain substantial conformance to the user's back while walking. However, even when endowed with this flexibility, backpack frame 140 may remain substantially rigid in response to a force applied away from a user's back such as, e.g., the weight of the load being carried. This novel mixture of flexibility and rigidness achieved by backpack frame 140 is discussed in more detail below and may generally be referred to herein as one-way flexing.

Backpack frame 140 may include, e.g., one or more columns of slots. Each column of slots may include, e.g., a plurality of slots arranged in a single column. As shown in FIG. 6, backpack frame 140 may include, e.g., at least one pair of columns of horizontal slots 144*a*, 144*b* and at least one pair of columns of vertical slots, wherein the at least one pair of columns of vertical slots may include a first pair of columns of vertical slots 145*a*, 145*b*, and a second pair of columns of vertical slots 146*a*, 146*b*. The columns of horizontal slots 144*a*, 144*b* may be used, e.g., to facilitate the coupling of harness 120 to backpack frame 140. The plurality of slots in columns of horizontal slots 144*a*, 144*b* may facilitate custom configuration of the harness 120 by allowing the harness 120 to be repositioned at any one of a plurality of heights that falls within the lowest horizontal slot within the column of horizontal slots 144*a*, 144*b* and the highest horizontal slot within column of horizontal slots 144*a*, 144*b*. The first pair of columns of vertical slots 145*a*, 145*b* and the second pair of columns of vertical slots 146*a*, 146*b* may facilitate the coupling of one or more accessories to backpack frame 140. Such accessories may include, e.g., a water pouch, water bottle, wing(s), bag(s), lid, shelf flap, knife sheath, rifle scabbard, bow container, arrow container, flashlight holder, or any other accessory that a user may take on a hike or hunt. In addition, or alternatively, backpack frame 140 may be configured such that recess 143*a* or recess 143*b* interrupts the first pair of columns of vertical slots 145*a*, 145*b* or the second pair of columns of vertical slots 146*a*, 146*b*.

Backpack frame 140 may include one or more openings such as, e.g., openings 142*a*, 142*b*, 142*c*, 142*d*, 142*e*, 142*f*, 142*g*, 142*h*. Any one opening of openings 142*a*, 142*b*, 142*c*, 142*d*, 142*e*, 142*f*, 142*g*, 142*h* in backpack frame 140 may be provided for a particular purpose. For example, an opening such as, e.g., openings 142*h*, 142*g* may be design particularly to facilitate, in conjunction with one or more slots, the custom configuration/adjustment of harness 120. Other openings such as, e.g., openings 142*a*, 142*b*, 142*c*, 142*d*, 142*e* may be designed particularly to facilitate one way flexing of the backpack frame 140. However, the backpack frame 140 of the present disclosure is not so limited. As such, it will be readily apparent to one of ordinary skill in the art, in light of the instant disclosure, that openings such as, e.g., openings 142*c*, 142*f* may serve dual purposes such as, e.g., custom configuration/adjustment of harness 130 and the facilitation of one way flexing. In addition, or alternatively, the openings may be provided for other purposes such as, e.g., providing air flow for breathability while the backpack system 100 is being worn by a user to carry a load, to achieve weight reduction of backpack frame 140, or other purposes that may not necessarily be expressly described herein.

Figure 7:
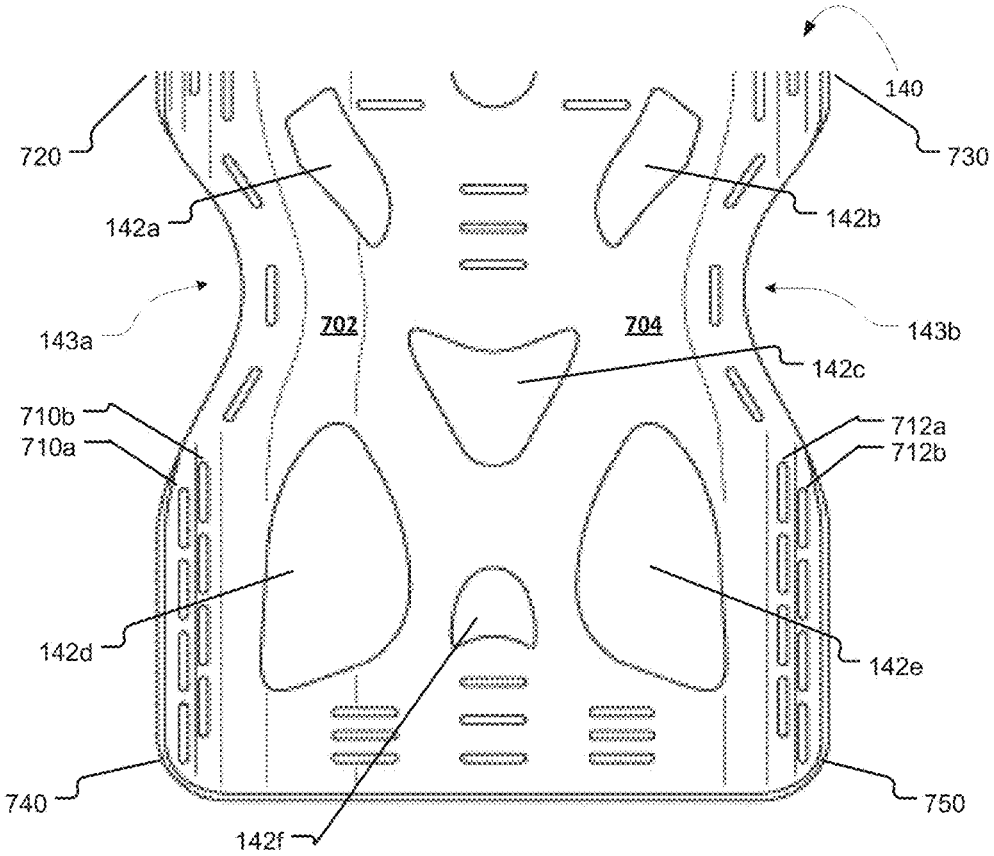
FIG. 7 shows an example of a flex portion of a backpack frame that may be associated with a backpack system in accordance with one aspect of the present disclosure.

FIG. 7 shows an example of a flex portion of backpack frame 140 that may be associated with backpack system 100 in accordance with one aspect of the present disclosure. The flex portion of backpack frame 140 may include, among other things, e.g., a plurality of openings 142*a*, 142*b*, 142*c*, 142*d*, 142*e*, 142*f*, a plurality of recesses 143*a*, 143*b*, and at least one pair of columns of vertical slots, wherein the at least one pair of columns of vertical slots may include a first pair of columns of vertical slots 710*a*, 710*b* and a second pair of columns of vertical slots 712*a*, 712*b*. One or more of the plurality of openings 142*a*, 142*b*, 142*c*, 142*d*, 142*e*, 142*f* and one or more of a plurality of recesses 143*a*, 143*b* may be arranged to create flex regions 702 and 704. Flex regions 702 and 704 may facilitate a one-way flexing, or pivoting, movement in backpack frame 140 that may adjust in response to a user's walking motion. This flexing, or pivoting, movement may allow backpack frame 140 to remain substantially conformed to a user's back to provide comfort and stability while the user is moving.

The flexing, or pivoting, movement provided by backpack frame 140, referred to herein as one-way flexing, may best be described by way of example of a user walking while utilizing backpack system 100. By way of example, when a user takes a step with the user's right foot, flex region 702 may, e.g., flex, pivot, or structurally bend and thereby facilitate the movement of backpack frame corner 720 in the forward direction towards a user's back. Concurrently, flex region 704 may, e.g., flex, pivot, or structurally bend and thereby facilitate the movement of backpack frame corner 750 in a rearward direction away from the user's back. Then, e.g., when a user brings the user's left foot even with the user' right foot, flex region 702 may, e.g., flex or pivot and thereby facilitate the movement of backpack frame corner 720 back to the original position backpack frame corner 720 was in prior to flexing. Concurrently, flex region 704 may, e.g., flex, pivot, or structurally bend and thereby facilitate the movement of backpack corner 750 back to the original position backpack frame corner 750 was in prior to flexing.

This process may be reversed when the user starts off by, e.g., taking a step with the user's left foot. By way of example, when a user takes a step with the user's left foot, flex region 704 may, e.g., flex, pivot, or structurally bend and thereby facilitate the movement of backpack frame corner 730 in the forward direction towards a user's back. Concurrently, flex region 702 may, e.g., flex, pivot, or structurally bend and thereby facilitate the movement of backpack frame corner 740 in a rearward direction away from the user's back. Then, e.g., when a user brings the user's right foot even with the user's left foot, flex region 704 may, e.g., flex, pivot, or structurally bend and thereby facilitating the movement of backpack frame corner 730 back to the original position backpack frame corner 730 was in prior to flexing. Concurrently, flex region 702 may, e.g., flex, pivot, or structurally bend and thereby facilitate the movement of backpack corner 740 back to the original position backpack frame corner 720 was in prior to flexing.

Due to the implementation of one-way flexing, as disclosed herein, backpack frame 140 may generally be susceptible to flexing in response to the forces applied while a user walks during utilization of backpack system 100, thereby enabling backpack frame 140 to maintain substantial conformance to the user's back while walking. In addition, backpack frame 140 may remain substantially rigid, and not substantially flex, when the weight of a load exerts a force on backpack frame 140 in the rearward direction away from a user's back. This substantial rigidity, which may be increased by the selection of material used to manufacture the frame, may allow backpack frame 140 to facilitate the carrying of loads that may weigh many times more than back pack frame 140. In accordance with at least one aspect of the present disclosure, e.g., a backpack frame manufactured using carbon fiber may facilitate the carrying of loads that may be up to, and potentially even in excess of, 100 times the weight of the backpack frame. With rigidity of this magnitude, the limiting factor in hauling a particular load tends to become the strength of the user carrying the load using backpack system 100 as opposed to the user's ability to carry a particular load being limited by the backpack.

It is contemplated that a backpack frame may fall within the spirit and scope of the disclosure and, e.g., not implement one-way flexing. Similarly, e.g., it is contemplated that a backpack frame may fall within the spirit and scope of the disclosure and, e.g., not be able to withstand the force exerted by a load that is, e.g., about 100 times heavier than the backpack frame. Accordingly, whether or not a particular implementation of the present disclosure requires one-way flexing, the strength to withstand a force exerted that is, e.g., about 100 times heavier than the backpack frame, or any other feature of backpack system 100 described herein may only be determined by the scope of the claimed invention as set forth below. The backpack frame may be configured to withstand forces greater or less than 100 times the backpack frame.

Figure 8:
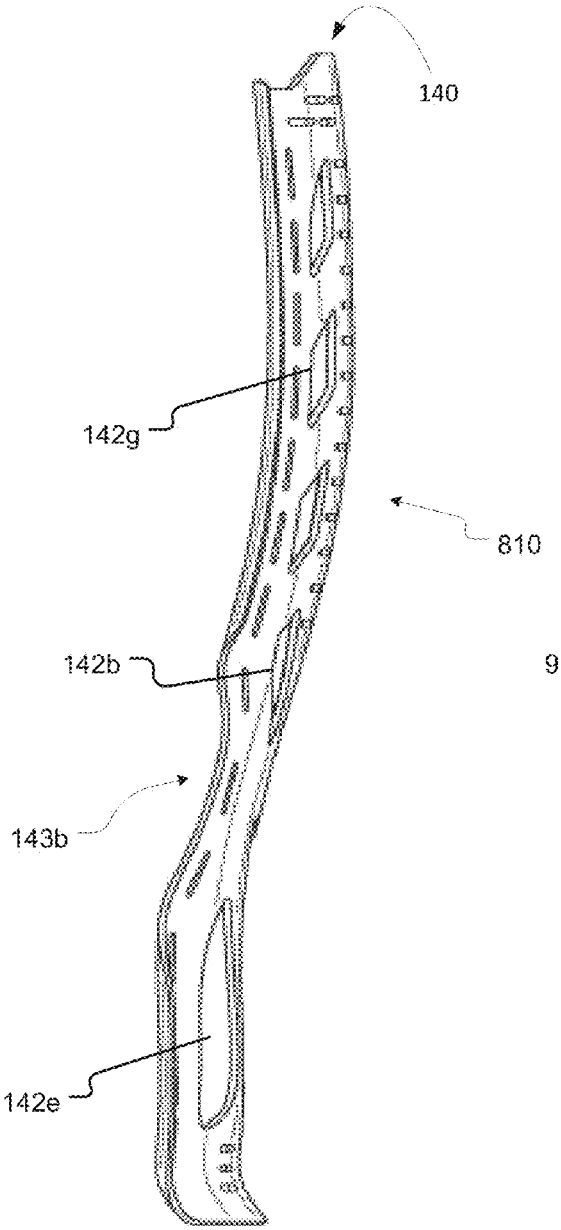
FIG. 8 shows an example of a side view of a backpack frame that may be associated with a backpack system in accordance with one aspect of the present disclosure.

FIG. 8 shows an example of a side view of backpack frame 140 that may be associated with backpack system 100 in accordance with one aspect of the present disclosure. The side view of backpack frame 140 set forth in FIG. 8 highlights, among other things, e.g., the curved profile 810 of backpack frame 140 that may result from the concaved face of backpack frame 140. As seen in FIG. 8, the backpack frame 140 has a longitudinal axis that may be configured to be substantially parallel to the user's back, while being simultaneously contoured to the shape of the user's back.

Figure 9:
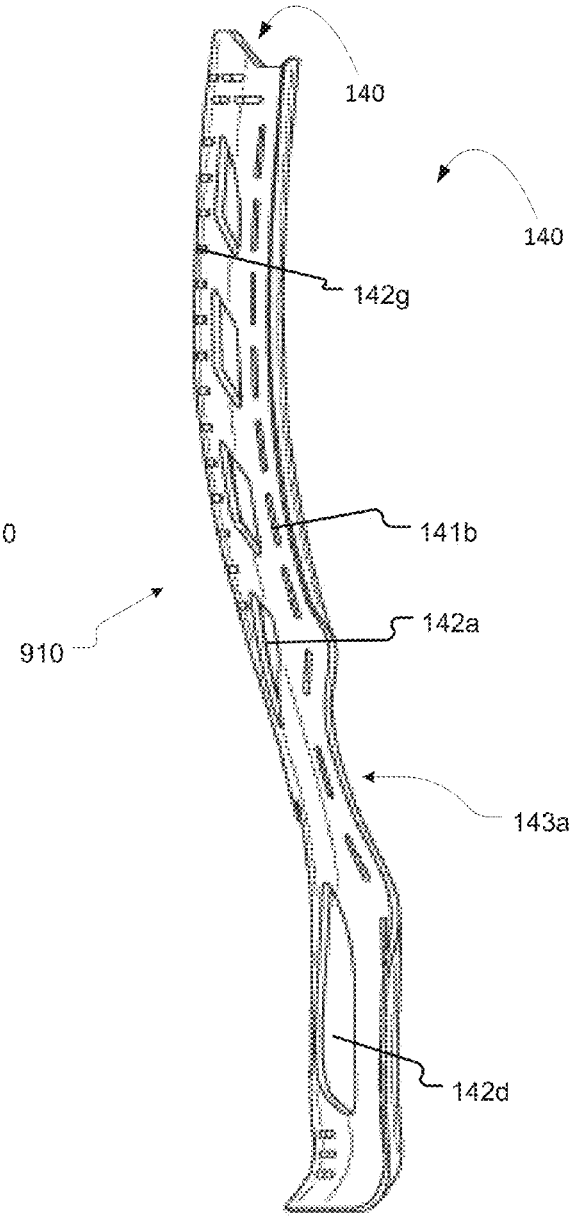
FIG. 9 shows an example of an alternate side view of a backpack frame that may be associated with a backpack system in accordance with one aspect of the present disclosure.

FIG. 9 shows an example of an alternate side view of backpack frame 140 that may be associated with backpack system 100 in accordance with one aspect of the present disclosure. The alternate side view of backpack frame 140 set forth in FIG. 9 highlights, among other things, e.g., the curved profile 910 of backpack frame 140 that may result from the concaved face of backpack frame 140.

While the present disclosure has been described in terms of exemplary embodiments, those skilled in the art will recognize that the present disclosure can be practiced with modifications in the spirit and scope of the appended claims. These exemplary embodiments given above are merely illustrative and are not meant to be an exhaustive list of all possible designs, embodiments, applications, or modifications of the present disclosure.

What is claimed is:

1. A backpack system comprising:

a storage section;

an upper harness;

a lower harness; and, a backpack frame, wherein the backpack frame comprises:

a first lower backpack frame corner and a second lower backpack frame corner, a plurality of flex portions including a first flex portion and a second flex portion that comprise a plurality of flex regions, the plurality of flex portions configured to facilitate pivoting movement in the backpack frame during walking by a user wearing the backpack frame, a plurality of openings, a plurality of recesses along opposite edges of the backpack frame that creates the plurality of flex portions, wherein the plurality of flex portions are configured to facilitate the pivoting by permitting the first lower backpack frame corner to move forward towards a back of the user and the second lower backpack frame corner to move rearward away from the back of the user while taking a first step.

2. The backpack system of claim 1, wherein the backpack frame further includes a slot.

3. The backpack system of claim 1, wherein the backpack frame includes a front face and a rear face, wherein the front face is concaved.

4. The backpack system of claim 1, wherein the backpack frame includes a plurality of columns of slots.

5. The backpack system of claim 4, wherein the plurality of columns of slots include a column of horizontal slots and a column of vertical slots.

6. The backpack system of claim 1, wherein the flex portion of the backpack frame includes a pair of columns of vertical slots, wherein each column in the pair of columns of vertical slots is substantially parallel to another column in the pair of columns of vertical slots.

7. An ergonomic backpack frame, comprising:

an opening;

a first lower backpack corner and a second lower backpack corner;

a first recess in an edge of the backpack frame; and, a second recess in another edge of the backpack frame, wherein the opening, the first recess, and the second recess are positioned to create a plurality of flex portions, including a first flex portion and a second flex portion, that accommodates one-way flexing, the plurality of flex portions configured to facilitate pivoting movement in the backpack frame during walking by a user wearing the backpack frame, and the plurality of flex portions configured to facilitate the pivoting movement by permitting the first lower backpack frame corner to move forward towards a back of the user and the second lower backpack frame corner to move rearward away from the back of the user while walking.

8. The ergonomic backpack frame of claim 7, wherein the flex portion includes a flex region.

9. The ergonomic backpack frame of claim 7, wherein the flex portion includes a first flex region and a second flex region.

10. The ergonomic backpack frame of claim 7, wherein the backpack frame substantially withstands flexing along its longitudinal axis in response to a force exerted by a load in the rearwards or vertical direction.

11. The ergonomic backpack frame of claim 7, wherein the backpack frame includes a front face and a rear face, wherein the front face is concaved.

12. The ergonomic backpack frame of claim 7, wherein the backpack frame permits flexing in a direction that is substantially perpendicular to a longitudinal axis of the backpack frame.

13. The ergonomic backpack frame of claim 7, wherein the backpack frame includes a column of horizontal slots and a column of vertical slots.

14. The ergonomic backpack frame of claim 13, wherein the first recess or the second recess intersects the column of vertical slots.

15. A backpack system, comprising:

a storage section;

an upper harness;

a lower harness, wherein the lower harness comprises:

lower back padding, an ergonomically designed hip belt, an adjustable hip belt strap adjuster, a first side pouch, a second side pouch; and, a backpack frame, wherein the backpack frame comprises a plurality of flex portions that comprises:

a flex region;

a plurality of openings; and, a plurality of recesses along an edge of the backpack frame, wherein the plurality of flex portions are formed by the plurality of recesses and includes a first flex portion and a second flex portion that accommodates one-way flexing, the plurality of flex portions configured to facilitate pivoting movement in the backpack frame during walking by a user wearing the backpack frame, and the plurality of flex portions are configured to facilitate the pivoting movement in the backpack frame by permitting a first lower backpack frame corner to move forward towards a back of the user while a second lower backpack frame corner moves rearward away from the back of the user while walking.

16. The backpack system of claim 15, wherein the ergonomically designed hip belt is inversely shaped.

17. The backpack system of claim 16, wherein the inversely shaped hip belt is configured in an upside down substantially U-shaped configuration.

18. The backpack system of claim 16, wherein the inversely shaped hip belt is configured to engage a user's hips so that the backpack system cannot slide down a user's back.

19. The backpack system of claim 16, wherein the backpack frame includes a plurality of slots and a plurality of openings.

20. The backpack system of claim 19, wherein the lower harness is coupled to the backpack frame using at least one of the plurality of slots and at least one of the plurality of openings.

21. The backpack system of claim 1, wherein the plurality of recesses along opposite edges begin to curve towards one another only in the lower half of the backpack frame.

22. The ergonomic backpack frame of claim 7, wherein the first recess and the second recess begin to curve towards one another only in the lower half of the backpack frame.

23. The backpack system of claim 15, wherein the plurality of recesses are on opposite edges and begin to curve towards one another only in the lower half of the backpack frame.

* * * * *